United States Patent [19]

Moulds

[11] 4,112,016

[45] Sep. 5, 1978

[54] POLYAMIDE FIBER

[75] Inventor: Gordon Mars Moulds, Waynesboro, Va.

[73] Assignee: E. I. Du Pont de Nemours and Company, Wilmington, Del.

[21] Appl. No.: 564,903

[22] Filed: Apr. 3, 1975

Related U.S. Application Data

[63] Continuation-in-part of Ser. No. 349,485, Apr. 9, 1973, abandoned.

[51] Int. Cl.[2] ..... C08K 5/31; C08K 5/34; C08L 77/10; C08L 61/26

[52] U.S. Cl. ..... 260/849; 260/45.8 NT; 260/45.9 NP

[58] Field of Search ..... 260/849, 857, 78 SC, 260/45.9 NP

[56] References Cited

U.S. PATENT DOCUMENTS

| | | | |
|---|---|---|---|
| 3,421,923 | 1/1969 | Guth | 117/136 |
| 3,644,083 | 2/1972 | Stockel et al. | 117/136 |
| 3,671,542 | 6/1972 | Kwolek | 260/30.2 |
| 3,699,192 | 10/1972 | Moretti | 117/136 |
| 3,734,684 | 5/1973 | Donaldson et al. | 117/138.8 N |

FOREIGN PATENT DOCUMENTS

| | | | |
|---|---|---|---|
| 761,985 | 11/1956 | United Kingdom | 117/136 |

*Primary Examiner*—John C. Bleutge

[57] ABSTRACT

This invention relates to fibers, filaments, yarns and fabrics of selected polyamides wherein the fibers contain the reaction product of absorbed reactants comprising a tetrakis(hydroxymethyl)phosphonium compound and a member of the group consisting of:

(A) melamine-formaldehyde condensate;
(B) melamine-formaldehyde condensate and magnesium ammonium phosphate hexahydrate;
(C) guanidine magnesium phosphate; and
(D) guanidine phosphate;

in such amount as to provide between 0.4 and 3.0% by weight of phosphorus.

3 Claims, 1 Drawing Figure

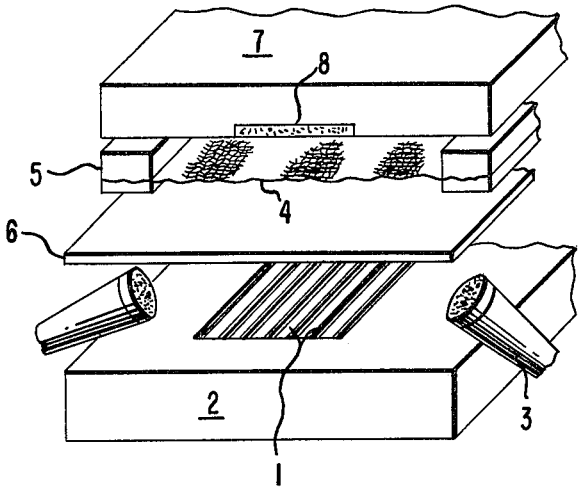
7
8
5
4
6
2
3
1

POLYAMIDE FIBER

CROSS REFERENCE TO RELATED APPLICATIONS

This application is a continuation-in-part of U.S. patent application Ser. No. 349,485, filed Apr. 9, 1973, now abandoned.

BACKGROUND OF THE INVENTION

Improvements in the thermal stability and flame retardant character of textile structures have become necessary to provide protective clothing suitable for use under the potentially adverse thermal conditions which may be encountered in, e.g., the operation of jet aircraft. As noted by van Krevelen in *Die Angewandte Makromolekulare Chemie* 22 (1972), 133–157 (Nr. 300), one aspect of the progress made in the search for heat resistant and nonflammable materials has been the development of highly cyclic polymers, both aromatic and heterocyclic, among them being the aromatic polyamides.

Methods indicated as useful for imparting greater heat resistance and reduced flammability to fibers and fabrics prepared from aromatic polyamides have been reported. However, these processes (e.g., semicarbonization, sulfuration, halogenation, and metallization) yield products possessing certain properties which tend to limit their broad applicability as textile materials. An obvious limiting property is the range of colors exhibited by the treated textile structures. These colors are variously identified to be, e.g., "darkened", dark brown, red-brown, blue-black, black, and reddish. A second limitation in these modified aromatic polyamides is the reduced elongation value exhibited by the treated fiber; it is acknowledged that such fibers cannot be converted as easily into woven fabrics or other shaped articles as can be the untreated fiber. It is recommended that the aforementioned prior art treatments be performed upon shaped articles (e.g., woven fabric) formed from the untreated fiber. Thus, both aesthetic appeal and processability of the treated fiber are diminished by these limitations. In addition, in order to achieve the desired transformation of the untreated products, it is indicated that the treatment processes need to be run under carefully controlled, critical conditions of time and temperature (elevated), features which can lead to significantly increased cost for the final product.

SUMMARY OF THE INVENTION

This invention provides novel fibers or filaments (hereinafter referred to as fiber) and other textile structures such as yarn and fabric made therefrom which are useful for clothing of improved fire protective qualities. This fiber consists essentially of a polyamide selected from the group of poly(p-phenylene terephthalamide), poly(chloro-p-phenylene terephthalamide), poly(p-phenylene chloroterephthalamide), and poly(p-benzamide), said fiber containing the reaction product of absorbed reactants comprising a tetrakis(hydroxymethyl)phosphonium compound and a member of the group consisting of:

(A) melamine-formaldehyde condensate;
(B) melamine-formaldehyde condensate and magnesium ammonium phosphate hexahydrate;
(C) guanidine magnesium phosphate; and
(D) guanidine phosphate;

in such amount as to provide between 0.4 and 3.0% by weight of phosphorus.

Yarn and fabric produced from the fiber possess good strength and aesthetic properties in addition to their thermal and flame-retardant qualities.

DESCRIPTION OF THE PREFERRED EMBODIMENTS

Useful Aromatic Polyamides

The suitable aromatic polyamides employed in this invention are selected from the group of poly(p-phenylene terephthalamide), poly(chloro-p-phenylene terephthalamide), poly(p-phenylene chloroterephthalamide), poly(p-benzamide). They may be prepared by the low temperature solution polymerization procedures reported in, e.g., Kwolek et al. U.S. Pat. No. 3,063,966 and Kwolek U.S. Pat. No. 3,671,542 and should have an inherent viscosity (measured as described hereinafter) within the range of 1.5–5.5, preferably between 2.5–3.5. In the event that the polymers of higher inherent viscosity are obtained by the polymerization procedures employed, the viscosity may be reduced by oxidative degradation of the high inherent viscosity polymer which can be placed in suitable temperature-resistant bags which allow air to enter but which prevent polymer dust from escaping. The bags are then heated in forced draft ovens at from, e.g., 190°–210° C., for up to 16 hours. This process yields polymer within the viscosity range suitable for use in this invention. Other exposure times and temperatures are suitable, e.g., approx. 20–25 min./275° C.; 60 min./250° C.; 4 hr./225° C. Also, this degradation can be carried out in high temperature steam under pressure or in superheated steam at atmospheric pressure. Suitable exposure times and temperatures are, for example, 3 hours at 200° C., 1½ hours at 210° C. and ½ hour at 225° C.

Spinning Dope Preparation; Fiber Spinning

Polyamides which have been prepared, isolated, washed, and dried by the procedures shown in the above-cited references are combined with concentrated sulfuric acid to form spinning dopes, some of which are anisotropic, e.g., as described and characterized in the aforesaid Kwolek U.S. Pat. No. 3,671,542. Preferably, the concentration of the sulfuric acid used for dope preparation is within the range of 100 ± 0.5%, and most preferably is about 100 ± 0.2%, by weight $H_2SO_4$. These dopes contain from 3 to 15% by weight polymer solids. The dopes are prepared by combining and mixing (mechanical agitation) appropriate quantities of dry polyamide and sulfuric acid at 70°–95° C. for a time sufficient to form the desired dope, e.g., from 1 to 4 hours. Appropriate dyes can be dissolved in the spinning dope to color the product fiber. Vacuum (e.g., 25–30 inches of mercury) is applied during the mixing operation in order to reduce the occlusion of air in the spinning dope. If stored, the dope is heated to about 65° C. prior to being spun. For spinning, the warm dope is filtered through fine mesh stainless steel screens, and then wet spun through a corrosion-resistant, fine capillary spinneret into a coagulation bath maintained within the range of 70°–95° C. The bath may be water or dilute sulfuric acid, preferably 5–10% by weight sulfuric acid. After traveling horizontally about 10–12 inches in the coagulation bath, the freshly formed filaments are carried by driven rolls into a series of baths which remove residual spinning solvent, and neutralize traces of residual sulfuric acid. The threadline is then led into a tank of pure water for a final rinse. If desired, a suitable textile finishing agent may be added to the last tank in order to facilitate textile processing, e.g., of the staple prepared from the fiber.

During the spinning operation a spin stretch factor, i.e., "SSF" (see Kwolek U.S. Pat. No. 3,600,350), of from 0.5–2.5 is experienced by the threadline.

The washed fibers emerge from the baths with speeds from 30–120 yd./min. Essentially no drawing occurs in the extraction baths. The wet tow (very porous) from the final wash may be piddled with fluted rolls into small tow cans and stored in this manner while wet and free of tension.

Fibers produced by the above-described processes (but dried) exhibit tenacities within the range of 1.5–7.0 gpd., elongations within the range of 8–50%, and initial moduli within the range of 10–250 gpd. Preferably the compositions of this invention in fiber form exhibit the following filament tensile properties: T/E/Mi: 4-6/9-14/70-140. Preferably, the product of the spinning operation exhibits a denier per filament value of about 1.25 ± 0.15.

Fiber Coloring

As previously noted, appropriate dyes (e.g., vat dyes) can be dissolved in the spinning dope to provide a wide range of colors for the fibrous products of this invention. Among the useful dyes and pigments may be named ("C.I." = Colour Index): Ponsol® Khaki 2G(C.I. Vat Green 8), Ponsol® Brilliant Violet 4 RN (C.I. Vat Violet 1), Ponsol® Yellow 5GLL (C.I. Vat Yellow 22), Ponsol® Blue BE(C.I. Vat Blue 6), Ponsol® Olive AR(C.I. Vat Black 27), Ponsol® Brilliant Red B(C.I. Vat Red 16), Ponsol® Red 2B(C.I. Vat Red 13), Ponsol® Red FG(C.I. Vat Red 52), Ponsol® Golden Orange RRT(C.I. Vat Orange 2), and Monastral Fast Blue B(C.I. Pigment Blue 15). These and other dyes which are soluble and stable in the acidic spinning dope, nonbleeding in acidic or basic aqueous scours, and wash- and lightfast are useful in this invention.

Absorption Process

Into the wet tow from the aforementioned spinning operation is absorbed a tetrakis(hydroxymethyl)phosphonium compound and a member of the group consisting of:

(A) melamine-formaldehyde condensate (e.g., Aerotex resin UM; a product of American Cyanamide Co.);

(B) melamine-formaldehyde condensate (e.g., Aerotex resin UM) and magnesium ammonium phosphate hexahydrate ($MgNH_4PO_4.6H_2O$);

(C) guanidine magnesium phosphate; and (D) guanidine phosphate;

Preferred for the treatment is the melamine-formaldehyde condensate.

Suitable tetrakis(hydroxymethyl)phosphonium methyl) compounds include the chloride (THPC), the so-called hydroxide (THPOH), the oxalate (THPOX), the phosphate, the acetate, etc., and mixtures of these compounds. Although the tetrakis(hydroxymethyl)-phosphonium (hydroxymethyl)phosphonium moiety of each of these compounds is sufficiently reactive to form a suitable insoluble reaction product with any of the coreactants A through D above, the preferred tetrakis(-hydroxymethyl)phosphonium compounds are THPOH and THPOX.

The weight ratio of tetrakis(hydroxymethyl)phosphonium compound to its coreactant (A) through (D) will range from about 2:1 to 5:1 with about a 5:1 ratio preferred. In the case of coreactant (B) the magnesium ammonium phosphate hexahydrate is present in amounts of up to 30% by weight of (B). As will be known to those skilled in the art, small amounts of a catalyst such as ammonium chloride may be used to promote the crosslinking of the melamine-formaldehyde condensate. Vircol 82 contains 11.3% phosphorus, two hydroxyl groups per phosphorus atom and a hydroxyl number of about 205.

Absorption into the fiber may proceed as follows. The previously described porous, wet, as-spun tow (containing about 5 parts of water per part of polymer) is piddled into a stock dyer and treated with an aqueous solution containing, e.g., based on weight of the wet fiber, 1% THPC, 0.2% Aerotex UM, and 0.007% ammonium chloride crosslinking agent. The tow and treating solution are heated together for 45 minutes at 80° C, then cured for 1¼–2 hours in 30–35 lb/in$^2$ steam. The tow is then given a neutralizing scour, e.g., with a solution of sodium carbonate and Duponol® D surface active agent (sodium salt of mixed long chain alcohol sulfates), after which it is dried at temperatures up to 150° C, preferably at 130°–150° C for 1 hour. Alternatively, the THPC could be neutralized before being added to the fiber.

The phosphorus content of the treated textile structures of this invention is within the range of 0.4 to 3.0% by weight, preferably from 0.8 to 1.3% by weight.

Product Utility

The fabrics of this invention exhibit excellent thermal and flame-retardant performance. As previously described herein, and illustrated further in the Examples which follow, their use in textile applications is especially preferred. Protective clothing prepared from these compositions can be advantageously worn, e.g., by workers who handle flammable liquids and gases in industrial plants, by firemen, by aviators, and by others who may be exposed to the hazards of catastrophic fires wherein escape from total immersion in flames becomes necessary. In these situations, being insulated from an extremely high heat flux for even a few seconds is vital.

Fabrics of this invention perform very well when exposed to high heat fluxes, e.g., one of 2.6 calories/cm.$^2$/sec., a flux representative of that produced by a jet fuel fire. Under such conditions, these fabrics effectively resist breaking open, an event which would destroy the air barrier existent between the fabric and the skin of the wearer who would be directly exposed to the convective and radiant energy of the heat source. They exhibit low shrinkage when exposed to high temperatures, thus maintaining between fabric and wearer the insulating air layer which reduces the rate of heat transfer to the wearer. Strength retention during exposure to flames is excellent for these fabrics, an important feature for a wearer who may be climbing or running to escape a fire. When fabrics prepared from the fiber of this invention are no longer exposed to open flame but are still subjected to a rather high level of radiant energy, they support minimal after flaming (i.e., 0–5 seconds), a very important quality. The limiting oxygen index value (LOI) for the compositions of this invention is high, e.g., 0.40.

In addition to these excellent thermal and flame-retardant characteristics, the fabrics of this invention exhibit other desirable qualities. It has already been noted that these fabrics may be obtained in a range of colors, an important aesthetic consideration. They exhibit good hydrolytic stability, e.g., as evidenced by a high level of retention of fabric breaking strength after 7 hours at the boil in 10% sulfuric acid. Fabrics exhibit excellent resistance to both pilling and abrasion and display desirable wash- and light-fastness properties.

The need for reliable and precise laboratory measurements in determining the capabilities of fabrics which will serve under conditions of severe thermal exposure is noted in Stoll et al. U.S. Pat. No. 3,148,531. The thermal and flame-retardant properties of the fabrics of this invention may conveniently and accurately be determined by the apparatus and test procedures described herein. The thermal evaluations to which the present compositions are subjected correlate very well with those obtained in the expensive and time consuming military pit tests wherein individual test runs are subject to uncertainties and difficultly reproducible flame sources, e.g., as noted in U.S. AARL Report, No. 71-24 (June, 1971) and in Department of Defense Report AD724648, "The Behavior of Protective Uniforms in Large-Scale Simulated Fires" (March, 1971).

MEASUREMENTS AND TESTS

Inherent Viscosity: Inherent viscosity ($\eta$inh) is defined by the following equation:

$$\eta inh = \frac{\ln (\eta rel)}{C}.$$

wherein ($\eta$rel) represents the relative viscosity and C represents a concentration of 0.5 gram of the polymer in 100 ml. of solvent. The relative viscosity ($\eta$rel) is determined by dividing the flow time in a capillary viscometer of a dilute solution of the polymer by the flow time for the pure solvent. The dilute solutions used herein for determining ($\eta$rel) are of the concentration expressed by (C), above; flow times are determined at 30° C.; the solvent is concentrated sulfuric acid (96–98% $H_2SO_4$).

Fiber Tensile Properties: Filament properties are measured on fibers that have been conditioned at 22° C. and 70% relative humidity (R.H.) for at least 8 hours unless otherwise specified. All measurements are made in the fiber conditioning environment.

Tenacity (breaking tenacity) (T), elongation (breaking elongation) (E), and initial modulus (Mi) are obtained from breaking filament bundles on an Instron tester (Instron Engineering Corp., Canton, Mass.).

Filament bundles are broken with a gage length (distance between jaws) of 1.0 inch (2.54 cm.). All samples are elongated at a constant rate of extension (60% elongation/minute) until the sample breaks.

The denier of a single filament (d.p.f.) is calculated from its functional resonant frequency, determined by vibrating 2.0 ± 0.1 cm. length of fiber under tension with changing frequency. (A.S.T.M. D1577-66, part 25, 1968). The denier of filament bundles is obtained by weighing a convenient length (i.e., 9 or 90 cm.).

The tenacity (grams/denier), elongation (%), and initial modulus (gram/denier) as defined in A.S.T.M. D2101, part 25, 1968, are obtained from the load-elongation curve and the measured denier.

Optical Anisotropy: Optical anisotropy may be measured by the procedures described in U.S. Pat. No. 3,671,542.

Home Laundering Procedure: Home laundering of fabrics as reported herein is performed by the procedure described in U.S. Pat. No. 3,123,587 (Example 2).

Testing Apparatus

An apparatus by which the heat- and flame-resistant characteristics of fabrics (e.g., those commonly used for military and protective clothing purposes) prepared from the fibers of this invention may be evaluated is shown in the FIGURE. The heat flux is supplied by combined radiant and convective sources. The radiant energy is supplied by nine quartz infrared tubes 1 (e.g., General Electric Co., Type T-3, 500 watts, each) to which a total of up to 45 amperes current is supplied from a power supply not shown. These tubes are located within a Transite box 2, ¼ inch thick, whose top is a water cooled ⅜–7/16 inch thick stainless steel jacket. Radiant energy from the quartz tubes is directed upward toward the fabric sample through a four inch × four inch opening in the top of the box. Convective energy is supplied by two Meker burners 3 positioned (on opposite sides) over the top of Transite box 2, each at an angle of about 45° from horizontal. The tops of the Meker burners are separated from each other by a distance of about 5 inches. In order to insure a constant gas flow rate, gas is fed to the burners through a flow meter from the fuel supply. The gas flow to these burners can be shut off by a toggle switch.

The test fabric sample 4 held in holder 5 can be brought into horizontal position above the heat flux provided by the tubes and burners by means of a carriage, not shown. When the sample is in this position, it is about 2¼ inches above the tops of the burners and about 3¾ inches above the infrared tubes. A 4 inch by 4 inch area of the fabric test sample is exposed to the heat flux unless otherwise indicated.

Located in a fixed position above the tubes and burners but below the "test position" plane of the fabric sample is a movable, water-cooled steel shutter 6. When located in the "closed position", i.e., directly above the heat flux, the shutter insulates the fabric test sample from the heat flux. When the shutter is removed from above the heat flux, the "open position", the fabric sample is exposed to the heat flux. The duration of the fabric exposure to the heat flux can be controlled by movement of the shutter into or out of "closed position".

The top member of the apparatus shown is an insulating (Marinite) block 7 containing a copper slug calorimeter 8 whose output is fed to an appropriate recording apparatus, not shown, by which the temperature rise (° F.) experienced by the calorimeter can be recorded on chart paper. The distance between calorimeter 8 and the top surface of a fabric sample 4 is ¼ inch.

In each of the following test procedures there is employed the apparatus previously described. Unless otherwise indicated, the heat flux in each test is a combination of radiant and convective energy in about a 50/50 ratio; the total heat flux to which each fabric sample is subjected is 2.6 calories/cm.$^2$/sec. In each test the quartz tubes and Meker burners are at operating temperatures and the shutter is in the "closed" position prior to exposure of the fabric sample which has been placed on the carriage in the "test" position.

Break Open Test

In this test the fabric sample is held taut in the holder, the shutter is opened, and the time required for the heat flux to cause a hole to form in the fabric is measured by an observer with a stopwatch.

Heat Transfer Test

A fabric sample is held taut in the holder, the Marinite block containing the calorimeter is clamped tightly to the top of the holder 5, and the shutter 6 is opened and closed by use of a timer, not shown, in order to expose the sample to the heat flux for a predetermined interval (e.g., 1 sec.; 2.5 sec.; 4 sec.). The temperature rise ($\Delta T$, ° F.) experienced by calorimeter is recorded. The $\Delta T$ which is measured and recorded during the exposure time plus the first 10 seconds after the shutter closes is taken as the heat transfer index. Between each successive test the Marinite block is unclamped from the holder 5 to allow the calorimeter to cool to room temperature prior to being used again.

After Flame Test

For this test horizontal sample holder 5 is replaced with another sample holder consisting of an inclined U-shaped metal plate whose base lies in the plane previously occupied by holder 5, whose parallel legs (each 4 inches long) are inclined in a downward direction at an angle of approximately 45°, such that the open end of the U points generally toward quartz infrared tubes 1, and oriented such that the vertical plane which passes through the two Meker burners 3 is a perpendicular bisector of the base of the U and also passes through the center of the (inclined) 2 inch wide aperture defined by the legs of the U. A 3 inch wide strip of test fabric is mounted spanning the legs of the U, one edge of the strip being flush with the end of each leg.

With shutter 6 open, quartz tubes 1 and burners 3 operating, the test is commenced by dropping the holder and sample into position, and allowing the burner flames to impinge on both fabric surfaces for a given interval, e.g., three seconds or five seconds. The Meker burners are then turned off, and the time required until any flames present on the fabric surface extinguish in the presence of the radiant energy supplied by the quartz tubes is measured. The latter time interval is reported as the after-flame time.

Strength Retention Test

In this test one end of a fabric sample about 2 inches wide and 10–12 inches long is clamped to an apertured metal plate mounted in the plane of sample holder 5, which permits exposure of a 2-inch × 2-inch area of the fabric to the heat flux. The unclamped end of the fabric sample is rolled into a small loop which is pinned into place. A hook is inserted in the loop and a cord is attached to the hook, passed over a metal rod and an appropriate weight is attached to the free end of the cord thereby applying tension to the fabric at the looped end. The length of cord is selected so that the weight is 2–3 inches above a bench top or other surface. The shutter is opened to expose the fabric to the heat flux. The length of time required to cause the weight to fall to the bench top or other surface as a result of a fabric-wide break occurring in the portion of the fabric exposed to the heat flux is measured. The time to break versus the breaking load of the fabric are determined from this test.

Fiber Systems

In the following list are shown "fiber systems" representing both imbibed fiber and untreated fiber from which were prepared the fabrics used in the evaluations demonstrated in the Examples. The fiber used in the manufacture of these systems was prepared by the procedure described below, incorporating dyes where used. Preparation of a "fiber system" is also described.

Spin dopes were made by dissolving 60 lbs. of dry poly(p-phenylene terephthalamide) and optionally, i.e., where "sage green" fibers are called for 0.48 lb. of Ponsol ® Khaki 2G and 0.12 lb. of Ponsol ® Brilliant Violet 4RN dry, crude grade in 440 lbs. of sulfuric acid at 100.0 ± 0.1% concentration to give 12% polymer solids. The solution was agitated in a Ross Planetary mixer at 70° ± 5° C for 3 to 4 hours with application of 26–27 inches of vacuum. Upon completion of mixing, solution was transferred to a storage tank jacketed to 60° ± 1° C, heated to 65° C in transfer lines and filtered at 65° C through 325 × 2300 mesh stainless steel screens. The wet spinning was carried out with spinnerets with about 1500 holes (0.0012 inch in diameter, each) with a capillary length to diameter ratio of 1/1. The spin bath was maintained at 80° ± 2° C and contained 8–10% $H_2SO_4$ by adjusting flow of pure water to compensate for the acid added from the spin dope. The 1.25 ± 0.15 dpf product was spun at 60 ypm. with a spin stretch factor of about 1.1. The threadline of about 1900-denier was washed by passing through three tanks of essentially pure water, a neutralizing tank containing sodium carbonate solution, and a final rinse tank with pure water. The increase in the speed of the rolls through the extraction-neutralization process was 3.4%.

The threadline is piddled with a gear piddler into small tow cans. The wet tow (17 lbs., dry weight basis) is placed in a stock dyer of 20 lbs. capacity. To this is added a room temperature solution comprising 300 lbs. of water, 4 lbs. of THPC, 0.8 lb. of Aerotex ® UM, and 12.7 grams of ammonium chloride. The contents of the dyer are heated to 80° C and the solution therein is recirculated for 45 minutes. The solution is then pumped out and the tow is treated with steam (35 lbs/in$^2$) for 90 minutes. The tow is then scoured for a few minutes with a solution of 0.8 lb. of sodium carbonate and 0.2 lb. of Duponol ® D in 40 gallons of fresh water. After this solution is removed, the tow is then rinsed with fresh water. The tow is removed and dried at 145° C for 1 hour. The fibers exhibit the following tensile properties (measured on bundles): T/E/Mi: 4.9/12.8/96 with a denier per filament of 1.25 ± 0.15. The dry tow is then crimped in a mechanical crimper and cut into 1½ inch staple. The dry, dyed fiber contains 1% by weight phosphorus (based on total weight of the dry fiber). The staple is then spun into yarn from which is prepared test fabrics employed in Examples 1–5, i.e., fiber systems F-1 through F-5. Fiber systems F-6-1 through F-6-7, illustrating a range of phosphorus contents and other choices of coreactants, are prepared in similar fashion by absorbing the reactants from appropriate solutions. By the term "absorbed" is meant that in each instance, the reactants are incorporated into a fiber that has not been dried since it was extruded from the spinneret. The percent of phosphorus (%P) in the fabric tested is shown. Also identified in this list are two related untreated fibers; one of these systems is undyed (F-6-8) and one is dyed Sage Green in color (F-6-9).

| Example | Fiber System | %P | Absorbed Reactants | | | |
|---|---|---|---|---|---|---|
| 1 | F-1 | 1.0 | THPC | 6.1%, | Aerotex UM | 1.2% |
| 2 | F-2 | 1.0 | " | 6.1%, | " | 1.2% |
| 3 | F-3 | 1.0 | " | 6.1%, | " | 1.2% |
| 4 | F-4 | 1.0 | " | 6.1%, | " | 1.2% |
| 5 | F-5 | 1.0 | " | 6.1%, | " | 1.2% |
| 6 | F-6-1 | 1.0 | " | 6%, | " | 1.2% |
| | F-6-2 | 0.64 | " | 3.8%, | " | 0.7% |
| | F-6-3 | 1.06 | " | 6.3%, | " | 1.3% |
| | F-6-4 | 0.68 | " | 4.0%, | " | 0.8% |
| | F-6-5 | 1.10 | " | 6.6% | " | 1.3% |
| | F-6-6 | 0.41 | " | 1.8% | guanidine magnesium phosphate hexahydrate 1% | |
| | F-6-7 | 1.25 | " | 6% | magnesium ammonium phosphate hexahydrate 2% and Aerotex UM 1.2% | |
| | F-6-8 | — | — | — | | |
| | F-6-9 | — | — | — | | |

*All fiber systems are dyed Sage Green by combined use of Ponsol Khaki 2G (0.8% on wt. of fiber) and Ponsol® Brilliant Violet 4RN (0.2% on wt. of fiber) except systems F-6-2, F-6-3 and F-6-8 which are undyed. F-6-8 and F-6-9 contain no treating agent.

EXAMPLE 1

This example illustrates that a fabric of this invention retains its desirable low heat-transfer and low afterflaming characteristics even after repeated commercial launderings.

A fabric sample (plain weave) is prepared from the fiber system identified herein as "fiber system E-1". This fabric sample is subjected to 10 commercial launderings. Separate portions of the laundered fabric sample are then subjected to 1, 2.5, and 4 second exposures, respectively, to the standard 2.6 cal./cm.$^2$/sec. combined heat flux by means of the "heat-transfer" procedure and apparatus described in the "Tests and Measurements" section. Data is obtained for an unlaundered control, also. The results are shown below.

Table 1

| | Temperature Rise (° F) Recorded After Exposure of | | |
|---|---|---|---|
| | 1 sec. | 2.5 sec. | 4 sec. |
| Fabric Samples | 9.5 | 26.5 | 42 |
| Control | — | 27 | — |

Two separate portions of the above-described commercially laundered fabric exhibit afterflame times of 3.4 and 3.6 seconds, respectively, when tested by the "Afterflame Test" procedure described herein (3 sec. exposure). An unwashed control fabric exhibits an afterflame time of 3.2 seconds.

EXAMPLE 2

This example illustrates that a fabric of this invention retains its desirable low heat-transfer and low afterflaming characteristics even after repeated home launderings.

A fabric sample (plain weave) is prepared from the fiber system identified herein as "fiber system F-2". This fabric sample is subjected to 30 home laundering operations as described herein in the "Tests and Measurements" sections. Separate portions of the laundered fabric sample are then evaluated for heat transfer and afterflaming as in Example 1 herein. The results are shown below:

Table 2

| | Temperature Rise (° F.) Recorded After Exposure of | | |
|---|---|---|---|
| | 1 sec. | 2.5 sec. | 4 sec. |
| Fabric Samples | 9 | 25.5 | 40 |

Two separate portions of the above-described laundered fabric each exhibit afterflame times of 3 seconds when tested as described in Example 1 herein.

EXAMPLE 3

This example illustrates that a fabric of this invention retains its desirable heat-transfer, low afterflaming, and dimensional stability characteristics after repeated commercial dry cleaning treatments.

Part A

A fabric sample is prepared from the fiber system identified herein as "fiber system F-3". Separate portions of this fabric sample are subjected to 5, 10, and 15 commercial dry cleaning treatments. The dry cleaned portions are then evaluated for heat transfer and afterflaming characteristics as in Example 1 herein. Results, including those from a control (no dry cleaning), are shown below:

Table 3

| | Temperature Rise (° F.) Recorded After Exposures of: | | |
|---|---|---|---|
| 5 Dry Cleanings | 1 sec. | 2.5 sec. | 4 sec. |
| Fabric Samples | 8 | 23 | 39 |
| Two samples show afterflame times of 1.5 and 3 sec., respectively. | | | |
| 10 Dry Cleanings | | | |
| Fabric Samples | 8 | 24 | 39 |
| Two samples each show an afterflame time of 1 sec. | | | |
| 15 Dry Cleanings | | | |
| Fabric Samples | 8 | 26 | 41 |
| Two samples show afterflame times of 0 and 1 sec., respectively. | | | |
| Control Samples | 10 | 25.5 | 42.5 |
| An afterflame time of 3 sec. is shown for 1 sample. | | | |

Part B

The dry cleaned fabric samples described above ae evaluated for shrinkage in both the warp and fill directions resulting from the dry cleaning. The following results are observed:

| Sample: | Shrinkage | |
|---|---|---|
| No. of Dry Cleanings | Warp | Fill |
| 5 | 0.4% | 0.1% |
| 10 | 0.4% | 0.1% |
| 15 | 0.6% | 0.0% |

These results compare very favorably with fabrics given commercial shrinkproofing treatments, i.e., where shrinkage is warranted to be within the range of 1–2%.

EXAMPLE 4

This example illustrates that a fabric of this invention exhibits excellent retention of strength during exposure to a combined radiant/convective heat flux of 2.6 cal./cm.$^2$/sec.

A fabric sample (plain weave) is prepared from the fiber system identified herein as "fiber system F-4". This sample (X) is exposed to the above-cited heat flux by means of the "strength retention" test procedure and apparatus described in the "Tests and Measurements" section. Testing loads employed and results obtained are shown below, including data for a sample (Y) of the test fabric which has received 25 commercial launderings.

TABLE 4

| | Strength Retention Measurements | | |
|---|---|---|---|
| Fabric Sample | Weight Applied To Fabric, lb. | Time to Break, Sec. | Breaking Load, lb./in. |
| X | 5 | 7.8 | 2.5 |
| | 7.2 | 5.8 | 3.6 |
| | 9 | 5.1 | 4.5 |
| Y | 5 | 10.9 | 2.5 |
| | 9 | 5.6 | 4.5 |

EXAMPLE 5

This example illustrates that a fabric of this invention exhibits excellent resistance to breaking open when exposed to a combined radiant/convective heat flux of 2.6 cal./cm.$^2$/sec.

A fabric sample (plain weave) is prepared from the fiber system identified herein as "fiber system F-5". This sample is exposed to the above-cited heat flux by means of the "break open" test described in the "Measurements and Tests" section. The fabric did not break open during an exposure period of 60 sec. Other samples performed in the same manner.

EXAMPLE 6

This example demonstrates the desirable thermal characteristics of a variety of fabrics of this invention. As shown in Table 5 below, the fabrics demonstrate the utility of various systems wherein the treating agent differs in both kind and amount (e.g., as measured by % phosphorus present). Shown are desirable low levels of heat transfer (as measured by temperature rise) and afterflame time following fabric exposure to a combined convention/radiant heat flux.

Fabric samples (2 × 2 left hand twill) are prepared from the "fiber systems" identified below. Individual portions of these fabric samples are then subjected to separate 1, 2.5, and 4 second exposures to the standard 2.6 cal./cm.$^2$/sec. combined heat flux by the method reported in Example 1. Other portions of these fabric samples are subjected to afterflame determinations by the method reported in Example 1. The results of these tests are shown below.

TABLE 5

| | Heat Transfer And Afterflame Data | | | |
|---|---|---|---|---|
| Fiber | Temperature Rise (° F.) After Exposure Time of: | | | Afterflame Time (Sec.) |
| System | 1 sec. | 2.5 sec. | 4 sec. | For Separate Samples |
| F-6-1 | 10 | 26.5 | 43 | 3 |
| F-6-2 | 11.2 | 28.8 | 44.9 | 4;5 |
| F-6-3 | 11 | 28.8 | 43 | 1;2 |
| F-6-4 | 11.5 | 28.8 | 43 | 3;4 |

TABLE 5-continued

| | Heat Transfer And Afterflame Data | | | |
|---|---|---|---|---|
| Fiber | Temperature Rise (° F.) After Exposure Time of: | | | Afterflame Time (Sec.) |
| System | 1 sec. | 2.5 sec. | 4 sec. | For Separate Samples |
| F-6-5 | 11 | 27.5 | 40.5 | 2;2 |
| F-6-6 | 11 | — | 43.5 | 4;4 |
| F-6-7 | 9.8 | 28 | 43.5 | 2.8;3 |
| F-6-8 | 11 | 29 | 45 | 5.5;7 |
| F-6-9 | 10.5 | 28 | 45 | 6;7 |

EXAMPLE 7

This example illustrates the use of phosphorus-containing treating systems whose performances are unacceptable (relatively long afterflame time) when contrasted to those systems used in this invention.

Poly(p-phenylene terephthalamide) fibers, spun and colored (Sage Green) as described herein, are separately treated (by the imbibition procedure described herein) to provide "fiber system F-7-1" and "fiber system F-7-2", respectively, In F-7-1 the fiber was treated with THPC (4.1% by weight, based on total fiber) and Victamide ® (an ammonium salt of an amido-polyphosphate with a particle size of less than 5 microns; product of the Victor Chemical Works; 4.1% by weight, based on total fiber); %P in the fiber is 0.85% by weight. In F-7-2 the fiber was treated with the cyclic trimer of phosphonitrilic diamide

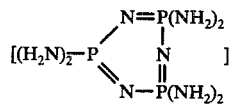

] (4.9% by weight, based on total fiber)

and Aerotex ® UM (1% by weight based on total fiber); %P in the fiber is 0.66% by weight. Fabric samples (2 × 2 left hand twill) are prepared from each of the fiber systems F-7-1 and F-7-2. Portions of these fabrics are each subjected to 10 industrial launderings. Laundered and unlaundered (i.e., control) portions of F-7-1 and F-7-2 fabrics are then subjected to afterflame determinations by the method reported in Example 1 (3 seconds exposure).

The results of these tests are presented in Table 6 below.

Table 6

| | Afterflame Data |
|---|---|
| Fiber System | Afterflame Time (sec.) for Separate Samples |
| F-7-1 Control | 2.6; 3.5 |
| F-7-1 Laundered | 5.8; 4.5 (Vigorous flame observed) |
| F-7-2 Control | 4.2; 4.2 |
| F-7-3 Laundered | 9.1; 5.2 (Intense flame observed) |

EXAMPLE 8

This example illustrates the use of "THPOH" as the tetrakis(hydroxymethyl)phosphonium compound.

Fiber system F-8 is prepared from similar fibers (except that they are colored "olive green" by appropriate choice of dyes) by a procedure analogous to that employed for fiber systems F-1 through F-5, except that the aqueous THPC solution is first neutralized by slowly adding a 50% caustic solution, with stirring, to bring the pH up to 7.4 ± 0.2. Although the literature recognizes that a variety of phosphorus-containing products may be produced by adding NaOH to THPC, for purposes of the present invention the active compounds present at pH 7.4 are here designated "THPOH". The Aerotex UM is then added to form the solution used to treat the wet fibers. The final scoured and dried F-8 fibers contain 1.15% phosphorus. Test fabrics from F-8 fibers exhibit after-flame times averaging about 1.5 seconds (range: 1–2.5 seconds); and a separate test sample, after undergoing 10 "C" laundry cycles, still exhibits an after-flame time of only 1 second.

EXAMPLE 9

This example illustrates the use of THPOX with a melamine formaldehyde condensate coreactant to produce the fibers of this invention.

Poly(paraphenylene terephthalamide) fibers spun and colored sage green as described hereinabove, are treated in a one pound capacity stock dyer as follows. 1650 gms of the wet tow (330 gms dry weight basis) is charged into the dyer and treated with a solution composed of 7000 m/s water, 200 mls THPOX (Pyroset TKS from American Cyanamide, 70% active ingredient) and 49 gms melamine formaldehyde condensate (Resloom HP from Monsanto Chemical Co.). The solution is circulated through the fibers while the system is heated over a period of 35 minutes to 140° F, and then held 20 minutes at that temperature. The solution is drained, and the fibers heated in 30 psig steam for 2 hours, following which they are scoured with a solution containing 3.5 gms Duponol ® D plus 14 gms sodium carbonate, rised twice with fresh water, dried, crimped, and cut to staple. The fibers contain 1.78 weight % phosphorus, and are spun into 37/2 c.c. yarns which are woven into a 54 × 40 plain weave fabric of 4.56 oz/yd$^2$ basis weight. Three separate portions of the fabric are tested for after-flame (three seconds exposure), and in each case, the after-flame time is less than one second (excellent). The heat transfer determined on separate test portions of the fabric is 27° F (2.5 seconds exposure) and 39° F (4 seconds exposure).

What is claimed is:

1. A polyamide fiber selected from the group of poly(p-phenylene terephthalamide), poly(chloro-p-phenylene terephthalamide), poly(p-phenylene chloroterephthalamide), and poly(p-benzamide), said fiber containing the reaction product of 2 to 5 parts of a tetrakis(hydroxymethyl)phosphonium compound and one part of a member of the group of (A) melamine-formaldehyde condensate;

(B) melamine-formaldehyde condensate and magnesium ammonium phosphate hexahydrate;

(C) guanidine magnesium phosphate; and (D) guanidine phosphate;

in such an amount as to provide between 0.4 and 3.0% by weight of phosphorus.

2. A fiber according to claim 1 which contains the reaction product of tetrakis(hydroxymethyl)phosphonium oxalate and melamine-formaldehyde condensate.

3. A fabric prepared from the fiber of claim 1.

* * * * *